United States Patent [19]

Glancy

[11] Patent Number: 4,882,856

[45] Date of Patent: Nov. 28, 1989

[54] CUSHION WEDGE FOR CUSTOM CONTROL OF IMPACT AND PRONATION UPON HEEL-STRIKE IN VARIOUS WEIGHTS OF WEARERS

[76] Inventor: John J. Glancy, 6280 Dean Rd., Indianapolis, Ind. 46220

[21] Appl. No.: 185,905

[22] Filed: Apr. 25, 1988

[51] Int. Cl.[4] ..... A43B 13/38

[52] U.S. Cl. ..... 36/43; 36/44; 36/92; 36/35 R

[58] Field of Search ..... 36/114, 30 A, 35 R, 36/35 A, 36 R, 43, 44, 92

[56] References Cited

U.S. PATENT DOCUMENTS

| | | | |
|---|---|---|---|
| 1,818,731 | 8/1931 | Mattison . | |
| 2,181,110 | 11/1939 | Esser | 36/36 |
| 2,954,618 | 10/1960 | Rados | 36/25 |
| 3,040,453 | 6/1962 | Gallardo | 36/36 R |
| 3,087,265 | 4/1963 | McKinley | 36/35 |
| 3,159,928 | 12/1964 | Clark | 36/36 |
| 3,738,373 | 6/1973 | Glancy | 36/35 A |
| 4,317,294 | 3/1982 | Goodyear | 36/100 |
| 4,429,474 | 2/1984 | Metro | 36/36 A |
| 4,430,810 | 2/1984 | Bente | 36/32 R |
| 4,573,279 | 3/1986 | Feurer-Zogel et al. | 36/35 R |
| 4,677,766 | 7/1987 | Gudas | 36/43 |
| 4,680,876 | 7/1987 | Peng | 36/35 B |
| 4,769,926 | 9/1988 | Meyers | 36/43 |

OTHER PUBLICATIONS

"Orthotics and Prosthetics", vol. 27, pp. 28–33, Mar. 1973, John Glancy, Co.

"Orthotics and Prosthestics", vol. 38, pp. 12–40, 1984, John Glancy, Co.

*Primary Examiner*—Donald Watkins

*Attorney, Agent, or Firm*—Woodard, Emhardt, Naughton, Moriarity & McNett

[57] ABSTRACT

An insert with a wedge shaped cushion portion of greater resiliency than the remainder of the insert which is designed and arranged to be inserted through the foot opening of a shoe into an upwardly opening cavity in the posterior portion of the shoe. The cushion wedge portion is positioned to control the range of rotation of the heel of a wearer upon heel-strike and is provided in different resiliencies so that the insert may be used to properly address the impact resulting from heel-strike in different weights of wearers.

17 Claims, 4 Drawing Sheets

CUSHION WEDGE FOR CUSTOM CONTROL OF IMPACT AND PRONATION UPON HEEL-STRIKE IN VARIOUS WEIGHTS OF WEARERS

FIELD OF THE INVENTION

This invention relates to shoe construction and more particularly to a shoe heel construction which has an interchangeable heel insert containing a cushion heel wedge arranged to control impact and pronation upon heel-strike in various weights of wearers.

DESCRIPTION OF THE PRIOR ART

Various methods and devices for addressing supination or pronation in a wearer, as well as replaceable soles and heels are disclosed by the following group of patent references. Each reference pertains in one way or another to addressing pronation or supination or supplying replaceable heels or soles to a shoe.

| Pat. No. | Patentee |
|---|---|
| 1,818,731 | Mattison |
| 2,181,110 | Esser |
| 2,954,618 | Rados |
| 3,040,453 | Gallardo |
| 3,087,265 | McKinley |
| 3,159,928 | Clark |
| 3,738,373 | Glancy |
| 4,317,294 | Goodyear |
| 4,429,474 | Metro |
| 4,430,810 | Bente |
| 4,573,279 | Feuer-Zogel et al. |
| 4,680,876 | Peng |

In addition to the above mentioned patents, there is an article by the inventor, John J. Glancy, entitled "Dynamic Control of Abnormal M-L Motion of the Os Calcis: The Cushion Heel Wedge—A Possible Solution" which appeared in the March 1973 Edition of *Orthotics and Prosthetics*, Vol. 27; pages 28–33 which is relevant to the present invention. This article describes what is believed to be the anatomical cause of Abnormal Medio-lateral motion, i.e. pronation and/or supination, and suggests that a cushion heel wedge can correct or control this abnormal motion, if the wedge is incorporated into the posterior portion of the midsole of a shoe. Similar suggestions are made on paqes 31–33 of an article entitled "Orthotic Control of Ground Reaction Forces During Running (A Preliminary Report)" by John Glancy. The entire article appears on pages 12–40 of the Autumn, 1984 edition of *Orthotics and Prosthetics*, Vol. 38, No. 3. Neither of these articles suggest that the cushion heel wedge could be incorporated into an insert which would be received in a cavity in the posterior portion of the midsole of a running shoe.

By far the most relevant patent to the disclosed invention, at least with regard to the manner in which pronation is addressed, is the inventor's own prior patent (Glancy, U.S. Pat. No. 3,738,373). While the inventor's prior patent addressed pronation by the use of a cushion wedge of greater resiliency than the remainder of the heel portion, as is done in the present invention, the prior patent envisioned that the cushion wedge portion would be a permanent part of the shoe. Thus, in order to address pronation in various weights of runners having the same size feet, it would be necessary for a shoe outlet to have a large number of shoes in the same size with the shoes incorporating cushion wedge portions having different resiliencies. The present invention, by using an interchangeable insert which replaces what would be the posterior midsole portion in a standard shoe, allows the shoe outlet to stock a single size of shoe, but stock a large variety of inserts having cushioned heel portions of different resiliencies which may be inserted into the shoe so that a given shoe size could custom control impact and pronation for different weights of runners with the same size of feet.

Bente (U.S. Pat. No. 4,430,810) discloses a running shoe with cylindrical apertures crossing through the heel for the insertion of support members transversely therethrough to harden the sole of the running shoe. The support members are color coded by the weight of the runner. Bente envisions the use of a plurality of bores so that the hardness of different areas of the sole can be different. However, Bente does not appear to mention the use of the inserts to address pronation. Additionally, the support members of Bente are inserted through bores extending throuqh the sides of the midsole, rather than inserting an insert which replaces a portion of the midsole throuqh a foot opening into a cavity in the shoe as is disclosed by the present invention.

Feuer-Zogel et al. (U.S. Pat. No. 4,573,279) is similar to Bente, but has an insert which is inserted longitudinally from the heel which is locked into place by support members inserted through transverse apertures. Unlike Bente, Feuer-Zogel addresses pronation and subsequent anti-pronation but does not explain how pronation is addressed except that it states that the rear support can follow the line of the weight bearing in roll-over. Feuer-Zogel, like Bente, uses support members inserted transversely through apertures in the midsole rather than using an insert which is inserted through the foot opening and replaces a portion of the midsole in a standard running shoe.

Peng (U.S. Pat. No. 4,680,876) in FIG. 20 shows a compressible shock absorbing heel with angular compression. Peng, however, does not apparently address pronation Peng's article of footwear, while it allows for angular compression of the heel, appears to be a very complicated device and is not suited for easy replacement or interchangeability of the heel portion.

Mattison (U.S. Pat. No. 1,818,731) discloses a heel for addressing pronation. The Mattison heel uses more resilient material on the medial portion of the heel than the lateral portion of the heel to address pronation. Thus, Mattison addresses pronation in exactly the opposite manner as pronation is addressed in the present invention.

Metro (U.S. Pat. No. 4,429,474) discloses a running shoe with a replaceable heel portion of spring steel to provide cushion and address pronation. The means for addressing pronation provided by Metro must be screwed into the heel of a running shoe and thus, alters substantially the external appearance of the running shoe.

Goodyear (U.S. Pat. No. 4,317,294) is an example of a running shoe with a replaceable outsole. Goodyear merely addresses shoe sole wear and does not address pronation or supination like the present invention.

Clark (U.S. Pat. No. 3,159,928). Gallardo (U.S. Pat. No. 3,040,453). McKinley (U.S. Pat. No. 3,087,265). Rados (U.S Pat. No 2,954,618), and Esser (U.S Pat. No. 2,181,110) are all examples of shoes with replaceable heel portions, none of which appear to address pronation. Additionally, none of these disclosed references seem to allow for replacement or interchangeability of the heel portion as easily as the disclosed invention.

SUMMARY OF THE INVENTION

One embodiment of the present invention is a shoe with an interchangeable heel insert for controlling impact and pronation upon heel-strike in various weights of wearers. The shoe has an upper with a foot opening an interior portion a posterior portion, a lateral side and a medial side. The upper is designed and arranged to receive a foot and is open downwardly in the Posterior portion. The shoe has a midsole connected to the anterior portion of the upper and a heel form connected to the posterior portion of the upper and to the midsole. The medial wall, lateral wall, bottom wall and heel wall of the heel form combine to define an upwardly opening cavity. The outsole is connected to the midsole and to the heel form and extends from the anterior portion to the posterior portion of the shoe. The shoe has an interchangeable insert which is designed and arranged to be inserted through the foot opening and received in the upwardly opening cavity. A cushioning element which is more compressible than the remainder of the insert, is incorporated into the insert. The cushioning element is located within the posteriolateral portion of the insert to custom control pronation resulting from impact forces creating rotation of the heel about the axis of the subtalar joint upon heel-strike.

A second embodiment of the present invention is an insert with a top surface that has an edge extending circumferentially around the surface. A bottom surface is located beneath the top surface with a spacing means extending between the top surface and the bottom surface. The spacing means is flush with the circumferential edge of the top surface but extends only partially across the bottom surface. A wedge shaped cushion of greater resiliency than the spacing means is mounted adjacent the spacing means and with the spacing means defines the bottom surface. The cushion has a smaller thickness adjacent the spacing means with a greater thickness outwardly of the spacing means. The cushion is flush with the edge and the bottom surface. The wedge shaped cushion in the insert initially positions the top surface at an acute angle with respect to the bottom surface but upon weight being applied to the top surface immediately yields until the top surface is substantially horizontal to the bottom surface. The cushion is positioned in the posteriolateral portion of the insert to control rotation of eversion of the heel upon the insert being inserted into a shoe.

Yet another embodiment of the present invention is a method for controlling eversion of the heel upon heel-strike in runners which includes the step of providing a plurality of sizes of running shoes with a cavity opening upwardly into the heel portion of the shoe adjacent to the shoes' foot opening. The method also includes the step of providing a plurality of inserts for different weight wearers with the insert designed to be received in the cavity in the heel portion of the shoe. The weight and foot size of the runner are then determined and the appropriate size of running shoe is selected from the provided shoes and also the appropriate insert is selected from the provided inserts. The selected insert is then inserted through the foot opening of the shoe into the cavity in the heel portion of the shoe.

One object of the present invention is to allow for the customization of running shoes to properly meet the individual needs of the runner while not requiring the shoe manufacturer to increase its current sizing allotments for any given volume of production.

Related objects and advantages of the present invention will be apparent from the following description.

DESCRIPTION OF THE PREFERRED EMBODIMENT

Figure 1:
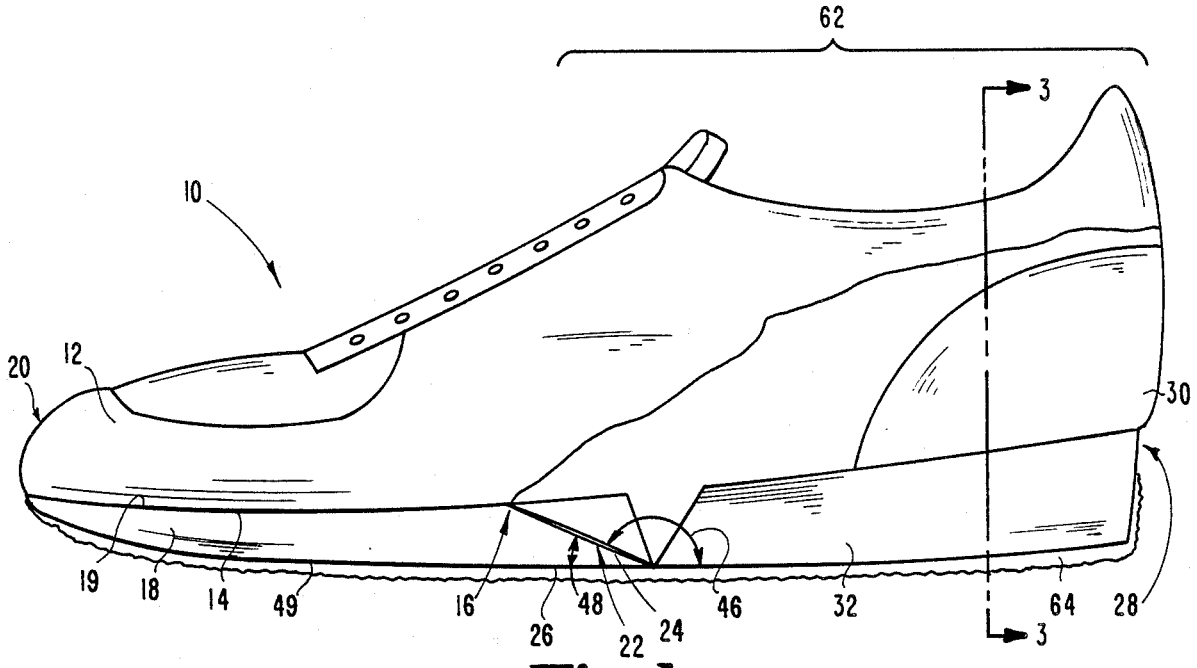
FIG. 1 is a partially cut-away left plan view of the lateral side of a running shoe for the left foot according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a running shoe 10 for the left foot of a wearer. Running shoe 10 has an upper 12 which is made and stitched together on its underside 14 in the same general manner as is commonly used in shoe construction except that the underside 14 is initially stitched only to the mp flexing break 16. An EVA midsole 18 is cemented, stitched, or otherwise appropriately secured on its upper side 19 to the underside 14 of the upper 12 and extends from the anterior end 20 of the shoe 10 to the mp flexing break 16. The midsole 18 has the same shape as a standard midsole in a running shoe at least to the mp flexing break 16. The posterior end 22 of the midsole 18 is a backward slanting incline 24 connecting the upper side 19 and the bottom side 26 of the midsole 18.

Figure 2:
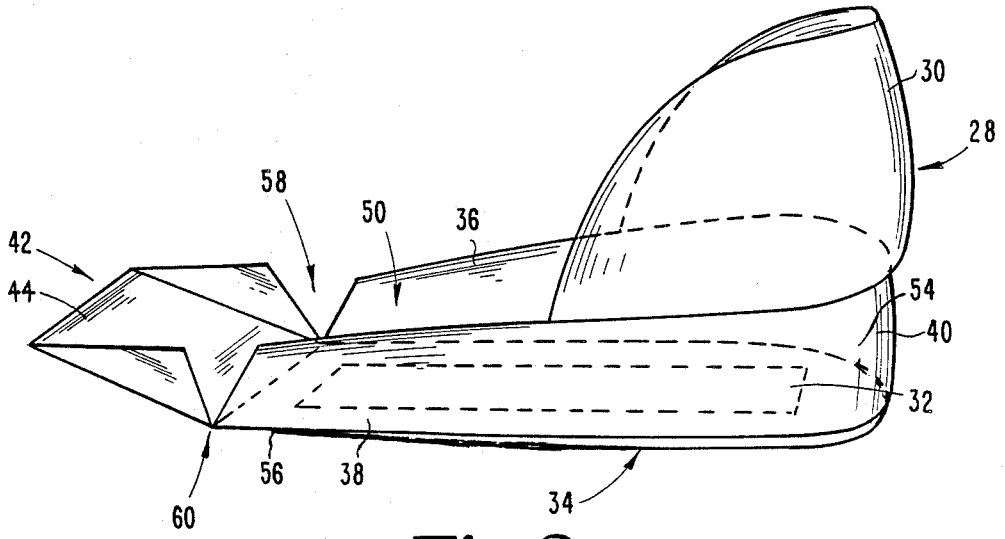
FIG. 2 is a perspective view of the combination board last and heel counter according to one embodiment of the present invention.

The form 28 (FIG. 2) is a pre-formed plastic, one-piece, combination heel counter 30 and board last 32. The heel counter 30 has the same general shape and performs the same general functions as a standard heel seat in a running shoe. The heel counter 30 is designed to be sandwiched between the outer 31 and the inner 33 layers of material in the upper (See FIG. 3) and extends around the the heel portion of the upper. The heel counter 30 reinforces the heel portion of the upper 12 and prevents medio-lateral motion of the heel with respect to the remainder of the shoe. However, the heel counter 30 should not extend forward of the region of the calcaneocuboid joint; thus avoiding interference with the looking and unlocking action of the normal transverse tarsal joint.

The board last 32 replaces and has the same general external shape as that portion of a standard EVA midsole which typically extends from the back of the heel forward to the top edge of the backward slanting incline 24 of the EVA midsole 18 of this shoe. The board last 32 has a bottom panel 34, a medial wall 36, a lateral wall 38 and a heel wall 40. On the anterior end 42 of the board last 32 there is a forwardly inclined tray 44 extending at an angle 46 (FIG. 1) from the bottom panel 34 between the medial wall 36 and the lateral wall 38. The angle 46 between the inclined tray 44 and the bottom panel 34 is supplementary to the angle 4B between the backward slanting incline 24 and the bottom surface 49 of the EVA midsole 18. The medial Wall 36, lateral wall 38, heel wall 40, inclined tray 44 and bottom panel 34 define an upwardly opening cavity 50 within which the cushion heel wedge insert 52, which will be described later, will be received.

From the point 54 on the medial wall 36 where the bottom panel begins to contour to accommodate the back of the heel and all along the lateral wall 38 to a point 56 approximately ½ inch back of the inclined tray 44, the bottom panel 34 is not attached to the heel wall 40 or lateral wall 38 of the board last 32. Along the remainder of the medial wall 36 and lateral wall 38, the bottom panel 34 is attached to the bottom edges of the sides of the board last. Thus, the bottom panel 34 is displacable upwardly and downwardly with respect to the remainder of the board last 32 as if the bottom panel 34 were actually two panels connected by a hinge extending between point 54 and point 56. The 'hinged' bottom panel's action ensures a quick and simultaneous response of the posteriolateral portion of the shoe heel and the cushion heel wedge insert 52 within the shoe at heel-strike. The action is the same as though the cushion heel wedge insert 52 were incorporated into the outside of a conventional, full length EVA midsole.

The "V"-shaped cutouts 58 on the medial wall 36 and lateral wall 38 directly above the posterior end 60 of the inclined tray 44 serve two purposes. The first purpose of the "V"-shaped cutouts 58 is to permit free flexion of the mp joints, and the second purpose is to reinforce the sides of the inclined tray 44 to enhance the overall, medio-lateral stability to the board last 32.

Figure 3:
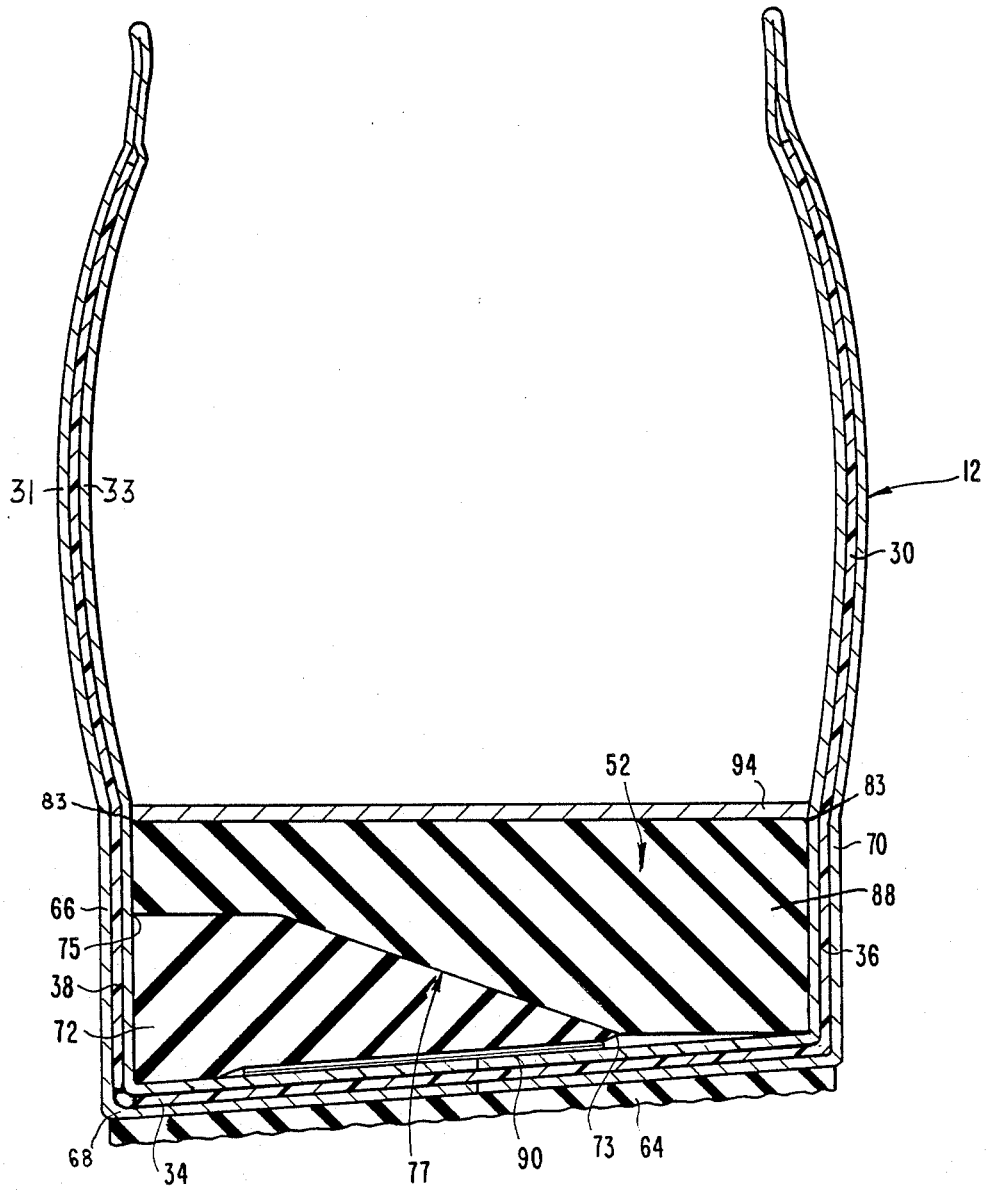
FIG. 3 is a cross sectional view along line 3—3 of the shoe of FIG. 1 with the interchangeable insert inserted therein.
Figure 5:
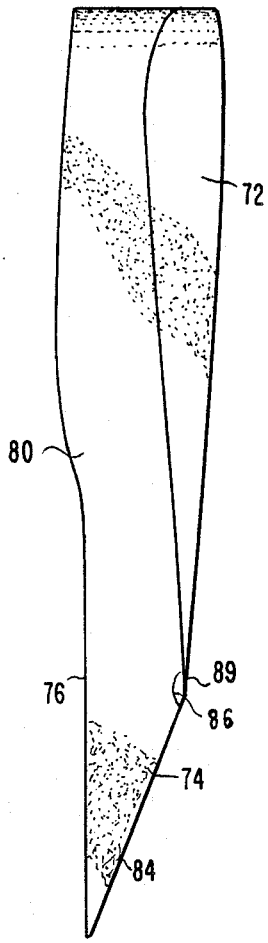
FIG. 5 is a plan view of the lateral side of an insert according to one embodiment of the present invention.
Figure 4:
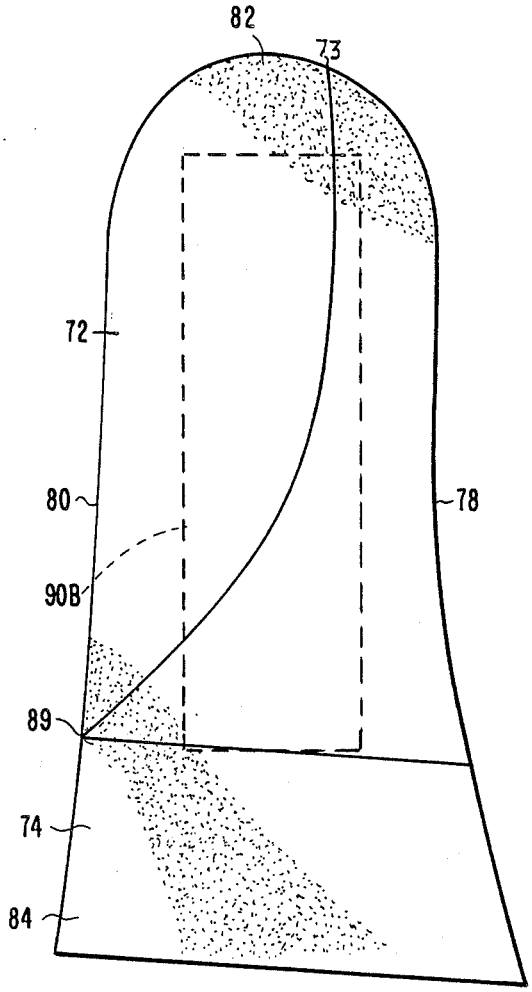
FIG. 4 is a bottom view of an insert for the left foot according to the present invention.
Figure 6:
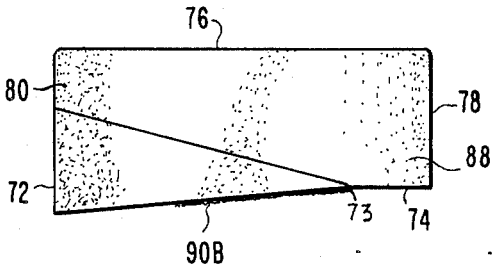
FIG. 6 is a back view of one embodiment of an insert according to the present invention.

The board last 32 is attached to the upper 12 and to the EVA midsole 18 to give the shoe 10 the outward appearance of a standard running shoe. The inner layer 33 of material of the upper is cemented or otherwise attached to the inner surfaces of the medial wall 36, lateral wall 38 and the heel wall 40. The inner layer 33 is not attached to the bottom panel 34 to avoid "boxing in" and thereby inhibiting its hinge action. The outer layer 31 of material in the upper is cemented or otherwise secured to the outer surfaces of the heel and side walls 36, 38 and 40 and bottom panel 34 of the board last 32. Since the material is flexible and on its outer side, there is no interference with the hinged action of the bottom panel 34. The inclined tray 44 is cemented to the incline 24 after the posterior portion 62 of the upper (i.e. that portion of the upper which is rearward of the mp flexing break) has been cemented to the board last 32. As is best seen in FIG. 3, the depth of the posterior portion 62 of the shoe upper 12 extends to the outsole 64 thereby covering the medial wall 36, lateral wall 38 and heel wall 40 of the combination plastic heel counter. The lateral side 66 and bottom portions 68 of the upper are patterned and sewn to extend ⅛" to 3/16" lower than the medial side 70. This extended portion reduces to zero inches at a point on the shoe which corresponds to posterior to the base of the 5th metatarsal head of a foot inserted in the shoe, matching the shaping of the cushion wedge portion 72 of the interchangeable, cushion heel wedge insert 52 hereinafter described.

The interchangeable cushion heel wedge insert 52 (FIGS. 3–6) is designed to rest upon the inside floor of the bottom panel 34 of the combination heel counter 30 and board last 32 after being inserted through the foot opening in the upper 12 and filling the upwardly opening cavity 50 in the board last 32. The cushion heel wedge has a bottom surface 74, a top surface 76, a medial surface 78, a lateral surface 80, a heel surface 82, and an inclined surface 84 extending between the top surface 76 and the bottom surface 74. The angle 86 between the inclined surface 84 and the bottom surface 74 is the same as the angle 46 between the inclined tray 44 and the bottom panel 34.

The cushion heel wedge insert 52 is sized and shaped to be snugly received in upwardly opening cavity 50 in the board last 32. Thus, the cushion heel wedge insert 52 is generally the same shape as the rear portion of a standard EVA midsole except that its dimensions are smaller to account for the width of the medial wall 36, lateral wall 38, heel wall 40, inclined tray 44 and bottom panel 34 of the board last 32. A peripheral edge 83 of the top surface 76 (FIG. 3) is defined by the intersection of the top surface 76 with the medial, lateral, heel and inclined surfaces 78,80,82,84. As is illustrated the top surface 76 and medial and lateral walls adjacent thereto may be contoured to provide heel elevation as is standardly done in running shoes.

A single cushion heel wedge insert 52 is constructed of materials having two different firmnesses or resiliencies. The firm or midsole portion 88 of the cushion heel wedge insert 52 must be sufficiently rigid to support the full weight of the wearer without compressing, thereby preventing pronation beyond the amount natural to the wearer at midstance. The degree of rigidity of the material in the firm or midsole portion 88 is related to the wearer's weight.

The firm or midsole portion 88 occupies substantially all of the area occupied by the cushion heel wedge insert 52 except for that portion which is occupied by the cushion wedge portion 72. Thus, the firm or midsole portion 88 extends between the top surface 76 and bottom surface 74 and is flush with the edge 83 of the top surface 76 but extends only partially across the bottom surface 74. Near the heel surface 82 the midsole portion 88 extends laterally ⅓ to ¼ of the way across the bottom surface 74 from the medial side 78. As is illustrated by the curve extending from point 73 to point 89 in FIG. 4, the extent to which the firm or midsole portion extends across the bottom surface varies posteriorly to anteriorly. From the point 73 one-third to one-fourth of the way across the bottom surface from the medial side 78 to a point 75 on the lateral wall 38, the firm or midsole portion has a surface which contiguously receives the adjacent surface of the cushion wedge portion 72.

The cushion wedge portion 72 is a wedge shaped portion of greater resiliency than the firm or midsole portion 88 and is mounted adjacent the firm or midsole portion 88. The cushion wedge portion 72 has a smaller thickness adjacent the firm or midsole portion 88 near the curve extending across the bottom surface from point 73 to point 89 with a greater thickness outwardly thereof which is flush with the lateral surface 80 and bottom surface 74 when the wedge is arranged to control excessive pronation caused by impact at heel-strike. The thickness of the cushion wedge portion 72 also decreases posteriorly to anteriorly with the thickness of the cushion decreasing to zero inches at point 89 on the cushion heel wedge insert 52 which is posterior to the lay (or position) of the 5th metatarsal head of a foot inserted into a shoe 10 containing the insert 52. The cushion wedge portion 72 has a surface which is continuously received by surface 77 of the midsole portion 88. As is illustrated in FIG. 3, this surface angles medially to laterally across the insert 52 from point 73 to point 75. Near the lateral surface 80 of insert 72 surface 77 and its corresponding surface on the cushion wedge portion 72 are substantially horizontal to the top surface 76 to provide stability.

In order to control impact forces and pronation upon heel-strike, the cushion wedge portion 72 initially positions the top surface 76 at an acute angle with respect to the bottom surface 74 and upon weight being applied to the top surface 76 yields immediately until the top surface 76 is substantially horizontal to the bottom surface at the instant of full weight bearing by the foot. The reasons for this positioning in a noncompressed state will be apparent from material discussed later. The cushion wedge portion 72 when combined with the firm or midsole portion 88 causes bottom surface 74 of the cushion heel wedge insert 52 to be 3/16" lower adjacent the lateral surface 80 than the medial surface 78 when the wedge is positioned to address pronation and is not compressed.

The cushion wedge portion 72 may be made from a variety of material, however excellent results have been obtained by producing the cushion wedge portion from foam materials.

The cushion wedge portion 72 may also be placed upon the firm portion 88 to control pathological conditions in which supination occurs during weight bearing. While the disclosure heretofore has described an embodiment of the invention which controls excessive pronation, it should be understood that aphasic supination can be addressed by placing the wedge portion 72 on the medial surface 78 rather than the lateral surface.

Figure 7:
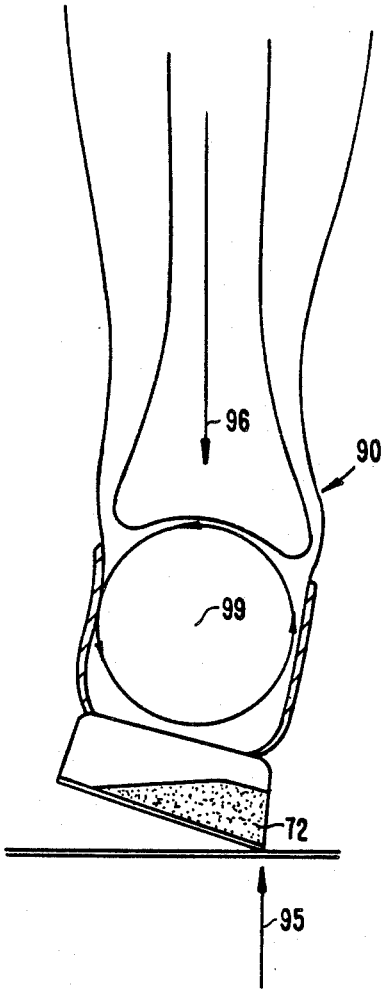
FIG. 7 is a diagramatic, posterior view of a right lower leg and foot, with the foot in its normal supinated position during the swing phase, just prior to heel-strike.
Figure 8:
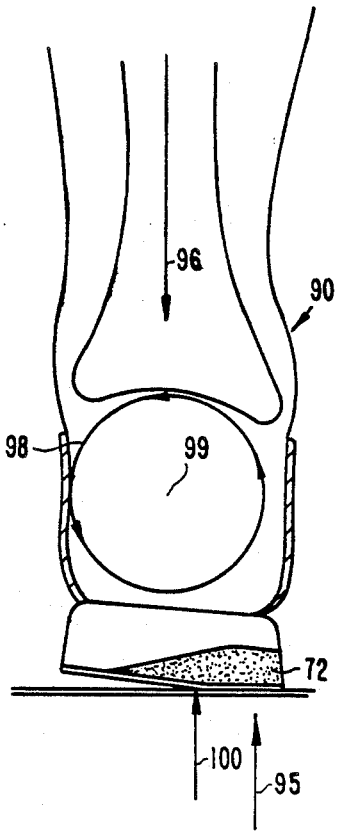
FIG. 8 is the same view of FIG. 7 following heel-strike and showing the cushion wedge compressing as it receives the initial impact.
Figure 9:
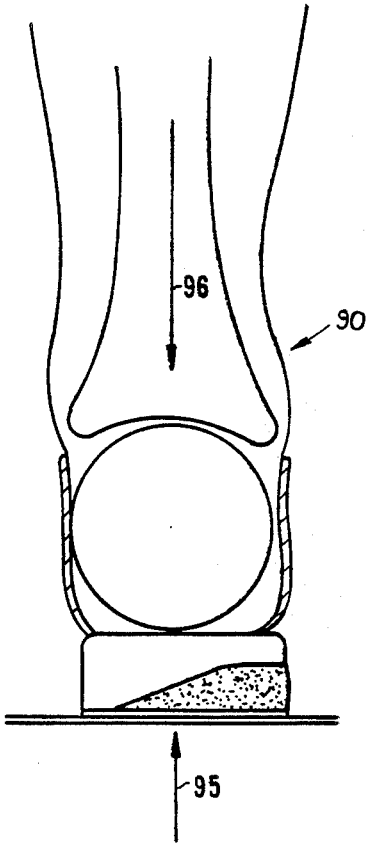
FIG. 9 is the same view as FIG. 7 and FIG. 8 but shows the foot in the midstance position of the gait cycle as it supports the full weight of the body and maintains mediolateral balance of the foot with respect to both leg and ground.

FIGS. 7, 8 and 9 illustrate how particular events within the normal heel-to-toe running cycle are controlled by the cushion wedge 52. These three figures depict a diagramatic, posterior view of the foot/ankle complex in order to focus upon the changes of the foot's relationship with respect to both the leg and the ground when running. A simplified outline of the tibia bone alone is shown to differentiate the skeletal portion of the leg from the foot. The fibula bone is not shown. The heel, i.e. the os calcis bone, is shown as a circle rotating about the subtalar joint's sagittal axis 99, which lies below the frontal axis of the ankle joint also not shown. The talus bone which lies between the tibia and os calsis bones has been left out. The cushion heel wedge is shown incorporated into the midsole of a conventional running shoe so that the action of insert 52, during the heel-to-toe running cycle may be better visualized.

FIG. 7 is a diagramatic, posterior view of a right lower leg and foot, with the foot in its normal supinated position during the swing phase, just prior to heel-strike.

FIG. 8 is the same view of FIG. 7 following heel-strike and showing the cushion wedge compressing as it receives the initial impact.

FIG. 9 is the same view as FIG. 7 and FIG. 8 but shows the foot in the midstance position of the gait cycle as it supports the full weight of the body and maintains mediolateral balance of the foot with respect to both leg and ground.

Immediate depression is essential in order to control the counterclockwise moment in the direction of arrow 98 about the axis of the subtalar joint 99, shown arbitrarily passing through the center of the circle representing the os calcis. Should there be a delay in the depression of the cushion portion, as would be the case if the foam material used in cushion portion 72 was too firm with respect to the wearer's weight, it would cause a blocking of the counterclockwise rotation 98 of the heel about the axis of the subtalar joint 99. Such a blockage interferes with the overall mediolateral balance of the runner due to the too firm material compacting into an unyielding, laterally inclined platform. When viewed singly. FIG. 8 shows the heel resting upon just such a laterally inclined surface which forces his body's center of gravity (CG) to shift laterally, outside his base of support. A mandatory expenditure of energy is now required to bring his CG back over his foot to prevent further lateral displacement. It should be noted that the runner must now raise his body up the incline with each stride. However, the contours of the articulating surfaces of the talus and os calcis bones, as well as their surrounding ligaments restrict the mediolateral rotation within the subtalar joint to specific limits. Under these circumstances, effort to restore overall mediolateral balance, via the subtalar joint 99, is not anatomically possible. Instead, the counterclockwise rotation needed to restore mediolateral balance occurs about contact point 100, which has become a fixed center point of rotation between the bottom of the shoe heel and the ground. This fatiguing expenditure of energy with each running stride adds nothing to the runner's forward progress and is therefore wasteful. The continuous retrieving of the lateral displacement of the runner's weight places unnatural stresses upon muscles, ligaments and joints of his lower limbs and cause injuries.

As the midstance position is reached, the cushion is made so that the amount of counterclockwise rotation of the heel is sufficient to bring the foot to a plantar grade position. The os calcis then rests on a level horizontal plane, parallel to the floor. The floor reaction force shifts to the medial half of the heel, as it follows the phasic medial progression of the CG, transferring the weight to the other limb. The amount and type of cushion material must be such that as the peak of the vertical load is achieved, the cushion does not "bottom out" when the heel becomes parallel to the floor. If the cushion wedge were to "bottom out" the effect would be similar to a solid medial wedge, i.e., the os calcis would then rest upon a laterally inclined surface in the horizontal plane. Thus the lateral portion of the os calcis is somewhat floating on the remaining air within the cell structure of the cushion material. The combination of the body's weight having been forced to create a counterclockwise moment, and a preponderance of the floor reaction force being shifted to the medial side, under the medial half of the os calcis, results in what appears to be a constant force couple about the subtalar joint which remains in balance whenever the limb is in the midstance position.

FIG. 8 depicts the cushion portion 72 showing its simultaneous compressing and changing of contour under the maximum vertical load (known to be 2.5 times body weight) at heel-strike. Within the instant between the completion of foot-flat and the beginning of the forward progression of the body over the foot, the vertical load is known to drop to zero. The vertical load then rapidly increases to its second peak within the running cycle, i.e. the full weight of the body at midstance. The ⅛" to 3/16" thicker lateral wedge of the cushion portion 72 is essential for absorbing the high impact at heel-strike without bottoming out, or inhibiting the normal counterclockwise rotation of the heel about the axis of the subtalar joint. It should he noted that the changing contour of the bottom of the cushion portion 72 that accompanies the compression is continuous until the midstance position is reached. This continuous changing of the contour of the underside of the cushion wedge 72, creates a series of instant center points, such as 100 shown in FIG. 8, which keeps the body's CG over the foot as the heel is rotating about the subtalar joint axis 99. The cushion wedge insert is designed to control both peak forces of the normal running cycle, without inhibiting its biodynamics.

Ideally, the action of the cushion wedge portion 72 should be such that upon weight being applied to the top surface 76 of the posteriolateral "corner" of the wedge portion would yield to the first very small amount of the high impact force that passes through it to the ground, offering increasing resistance as the impact magnitude reaches its peak for any runner of a given weight. Thus, the cushion wedge portion 72 should come in an infinite number of densities to address the various weights of runners. However, favorable results can be achieved using a cushion wedge portion 72 of a given density for runners of similar weights. Thus, it is estimated that for purposes of mass production, the densities for the cushion wedge portion 72 would be in increments of 25 pounds; that is, 6 cushion wedge portion densities for runners weighing 125 to 250 pounds and over, with one density for those under 125 pounds.

A Velcro® strip 90 is provided in order to prevent unwanted overall movement of the cushion heel wedge insert 52 within the board last 32. One half of the Velcro® strip 90A is riveted to the inside floor of the bottom panel 34 of the board last 32, and its opposite half 90B is cemented to the bottom surface 74 of the cushion heel wedge insert 52. The inclined tray 44 and inclined surface 84 are kept free of Velcro®. The sliding action at the inclination, between the inclined surface 84 of the cushion heel wedge insert 52 and the smooth surface of the inclined tray 44 provides even more freedom for the dorsiflexion of the mp joints. The strip half 9OB cemented on the bottom surface 74 of the cushion heel wedge insert 52 is cemented into an indentation in the bottom surface 74 to avoid any medio-lateral instability by ensuring that the bottom surface 74 is in total contact with the floor of the bottom panel 34.

A conventional molded removable innersole 94 (as currently used) is inserted over the proposed construction after the cushion heel wedge insert 52 is inserted into the upwardly opening cavity 50 of the board last 32.

An improved method of providing running shoes to runners of different weights is addressed by the present invention. A large number of shoes in various sizes can be manufactured and provided to runners so that they can select an appropriately sized shoe. These shoes would have the same general outward appearance as present running shoes but would have an upwardly opening cavity in the posterior portion of the shoe where the posterior portion of the midsole would normally be found. In addition to the various sizes of shoes, matching sizes of inserts would be provided which could be inserted into the upwardly opening cavity in the shoes through the foot opening to give the shoes an internal construction similar to the internal construction of standard running shoes. These inserts would be manufactured with a wedge shaped portion incorporated therein which is situated to address impact forces and prevent excessive pronation in the runner. The wedge shaped portion in the inserts provided would be graded by the weight of the runner with inserts designed for lighter runners having more resilient wedge portions than inserts designed for heavier runners. As previously described, it is envisioned that for mass production, it will be sufficient to supply inserts in each size with wedged shaped portions having six different resiliencies. Retail outlets would thus be able to keep their stock levels lower than if the wedge shaped portions were incorporated directly into the midsole of a standard running shoe because they would only be required to stock a normal number of shoes and could stock as many inserts as necessary to be inserted within the shoes rather than stocking a great number of shoes so that a shoe with an appropriate wedge portion would be available. The runner would then select the appropriate sized shoe which would be provided with an insert with a wedge portion of appropriate resiliency for the runners weight.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. The disclosure has referred to running shoes, however, it should be understood that the invention may be beneficially incorporated into other types of shoes to control ground reaction forces and still come within the teachings of the invention.

What is claimed is:

1. A shoe having an elevating heel portion, comprising:

an upper having a foot opening, an anterior portion, a posterior portion, a lateral side and a medial side, said upper being designed and arranged to receive a foot and being open downwardly in the posterior portion;

a midsole connected to the anterior portion of said upper;

a form including a combination board last and heel counter, said form having a medial wall; a lateral wall, a bottom panel and heel wall defining an upwardly opening cavity coextensive with the elevating heel portion of the shoe, said form being connected to the posterior portion of said upper and to said midsole;

an outsole connected to said midsole and said form and extending along said upper from said anterior portion to said posterior portion thereof; and an insert means for reducing impact forces and controlling medio-lateral rotation at heel-strike, said means including an interchangeable insert sized and arranged to be inserted in said upwardly opening cavity coextensive with the elevating heel portion of the shoe through said foot opening and to be removable therethrough, said insert having a cushion portion incorporated therein which is more compressible than the remainder of said insert.

2. The shoe of claim 1 wherein said insert further comprises:

a top surface having an edge extending circumferentially therearound;

a bottom surface beneath said top surface;

a firm portion defining said top surface and only partially said bottom surface and extending flush from said edge; and, wherein said cushion portion is wedge shaped and is of greater resiliency than said firm portion firm portion and wherein further, said cushion portion has a smaller thickness adjacent said firm portion along said bottom surface with a greater thickness outwardly thereof being flush with said edge, said top surface being initially positioned at an acute angle with respect to said bottom surface and upon weight applied to said top surface said cushion portion yields immediately until said top surface is substantially parallel to said bottom surface.

3. The shoe of claim 1 wherein the thickness of said cushion portion increases laterally to provide control of the eversion range of rotation of the heel bone to address pronation.

4. The shoe of claim 1 wherein the thickness of said cushion portion increases medially to cause corrective rotation of the heel bone to address conditions involving abnormal supination during weight bearing.

5. The shoe of claim 1 wherein said upper is open downwardly posteriorly from at least the point in said upper corresponding to the mp flexion point in a foot of a wearer to be inserted therein and said midsole is connected to said upper anteriorly of the point in said upper corresponding to the mp flexion point in said foot.

6. The shoe of claim 5 wherein said cushion portion is positioned laterally within said shoe to control the eversion range of rotation of the heel bone of a wearer following heel-strike to control pronation.

7. The shoe of claim 1 wherein said form further includes an anterior section of said bottom panel which is attached to the medial wall and the lateral wall of said form;

a posterior section of said bottom panel underlying said cushion portion of said insert which is disattached from the medial and lateral wall of said form whereby said posterior section of said bottom panel is displaceable upwardly and downwardly with respect to the heel wall.

8. The shoe of claim 2 and further comprising:

a first Velcro® strip attached to said bottom surface of said insert;

a second Velcro® strip attached to the bottom panel; and, wherein said first and second Velcro® strips are positioned to removably secure said insert within said upwardly opening cavity.

9. An insert for controlling the range of rotation of the heel bone upon heel-strike and adapted for interchangeable insertion through a foot opening into a cavity in the posterior portion of a midsole of a shoe coextensive with the elevating heel portion thereof, comprising:

a top surface having an edge extending circumferentially therearound;

a bottom surface beneath said top surface;

a firm portion extending between and defining said top surface and only partially said bottom surface and extending flush from said edge; and, a wedge shaped cushion composed of a material having greater resiliency than said firm portion and being mounted adjacent said firm portion, said cushion having a smaller thickness adjacent said firm portion along said bottom surface with a greater thickness outwardly thereof being flush with said edge;

wherein when said insert is inserted in the shoe cavity coextensive with the elevating heel portion of the shoe, said top surface is positioned at an acute angle with respect to said bottom surface and upon weight applied to said top surface said cushion yields immediately until said top surface is substantially parallel to said bottom surface.

10. The insert of claim 9 wherein said cushion element has a thickness which decreases posteriorly to anteriorly.

11. The shoe of claim 9 wherein the thickness of said cushion increases laterally to cause corrective rotation of the heel bone to control the eversion range of rotation of the heel bone in pronation.

12. The shoe of claim 9 wherein the thickness of said cushion portion increases medially to cause corrective rotation of the heel bone to address conditions involving abnormal supination during weight bearing.

13. The shoe of claim 7 wherein the anterior end of said insert includes an inclined surface extending between said top surface and said bottom surface of said insert, said midsole extending from the anterior end of said shoe to the mp flexing break, said midsole having a bottom surface and also including an inclined surface extending along the posterior end of said midsole coextensive with the mp flexing break, said form including an inclined tray extending anteriorly from said bottom panel, said inclined tray affixed to the inclined surface of said midsole.

14. The shoe of claim 13 wherein the angle between said inclined tray and said bottom panel are supplementary to the angle between the inclined and bottom surfaces of said midsole.

15. The shoe of claim 13 wherein said medial and lateral walls of said form define cutouts therein above the posterior end of said inclined tray, said cutouts providing free flexion of the mp joints in the foot of a wearer.

16. The shoe of claim 13 wherein said cushion portion has a thickness which decreases posteriorly to anteriorly.

17. The shoe of claim 13 and further comprising:

a first Velcro® strip attached to said bottom surface of said insert;

a second Velcro® strip attached to the bottom panel; and, wherein said first and second Velcro® strips are positioned to removably secure said insert within said upwardly opening cavity.

* * * * *